US005854198A

United States Patent [19]

Appel et al.

[11] Patent Number: 5,854,198

[45] Date of Patent: Dec. 29, 1998

[54] PARTICULATE ALUMINOSILICATE-BUILT DETERGENT COMPOSITIONS COMPRISING COGRANULES OF ZEOLITE MAP AND ALKALI METAL SILICATE

[75] Inventors: Peter Willem Appel, Rotterdam; Theodorus Johannes Arts, Maastricht; Jelles Vincent Boskamp, Vlaardingen, all of Netherlands; Andrew Paul Chapple, Wrexham, United Kingdom; Fredericus Cornelis Dobbe, Oegstgeest, Netherlands; Christophe Michel Joyeux, Montluel, France; Carolyn Angela Lanceley, Chester, United Kingdom; Edwin Leo Lempers, Maassluis; Theo Jan Osinga, Cadier en Keer, both of Netherlands

[73] Assignee: Lever Brothers Company, Division of Conopco, Inc., New York, N.Y.

[21] Appl. No.: 818,191

[22] Filed: Mar. 14, 1997

[30] Foreign Application Priority Data

Mar. 15, 1996 [GB] United Kingdom ..... 9605534

[51] Int. Cl.[6] ..... C11D 3/08; C11D 17/00; C11D 3/395

[52] U.S. Cl. ..... 510/444; 510/315; 510/334; 510/377; 510/507; 510/511; 510/532

[58] Field of Search ..... 510/444, 315, 510/334, 377, 507, 511, 532

[56] References Cited

U.S. PATENT DOCUMENTS

| | | | |
|---|---|---|---|
| 4,265,777 | 5/1981 | Boyer et al. | 510/346 |
| 4,487,710 | 12/1984 | Kaminsky | 510/352 |
| 4,526,698 | 7/1985 | Kuroda et al. | 252/99 |
| 4,528,276 | 7/1985 | Cambell et al. | 502/62 |
| 4,604,224 | 8/1986 | Cheng | 252/91 |
| 4,664,839 | 5/1987 | Rieck | 252/175 |
| 4,707,290 | 11/1987 | Seiter et al. | 510/443 |
| 4,728,443 | 3/1988 | Rieck et al. | 251/8.6 |
| 4,820,439 | 4/1989 | Rieck | 252/135 |
| 4,834,902 | 5/1989 | Pioch et al. | 510/232 |
| 5,009,804 | 4/1991 | Clayton et al. | 510/299 |
| 5,354,493 | 10/1994 | Wilms | 510/444 |
| 5,378,388 | 1/1995 | Pancheri | 510/315 |
| 5,393,455 | 2/1995 | Poethkow et al. | 252/174.25 |
| 5,518,649 | 5/1996 | Chapple et al. | 510/443 |
| 5,529,710 | 6/1996 | Van Dijk et al. | 510/404 |
| 5,536,441 | 7/1996 | Chapple et al. | 510/310 |
| 5,565,145 | 10/1996 | Watson et al. | 510/350 |

FOREIGN PATENT DOCUMENTS

| | | |
|---|---|---|
| 0021267 | 1/1981 | European Pat. Off. . |
| 340 013 | 11/1989 | European Pat. Off. . |
| 367 339 | 5/1990 | European Pat. Off. . |
| 384 070 | 8/1990 | European Pat. Off. . |
| 390 251 | 10/1990 | European Pat. Off. . |
| 565 364 | 10/1990 | European Pat. Off. . |
| 420 317 | 4/1991 | European Pat. Off. . |
| 425 277 | 5/1991 | European Pat. Off. . |
| 460 925 | 12/1991 | European Pat. Off. . |
| 521 635 | 1/1993 | European Pat. Off. . |
| 522 727 | 1/1993 | European Pat. Off. . |
| 0533392 | 3/1993 | European Pat. Off. . |
| 550 077 | 7/1993 | European Pat. Off. . |
| 567 140 | 10/1993 | European Pat. Off. . |
| 578 871 | 1/1994 | European Pat. Off. . |
| 634 479 | 1/1995 | European Pat. Off. . |
| 639 639 | 2/1995 | European Pat. Off. . |
| 653 480 | 5/1995 | European Pat. Off. . |
| 657 527 | 6/1995 | European Pat. Off. . |
| 3942066 | 6/1991 | Germany . |
| 1 451 719 | 10/1976 | United Kingdom . |
| 1 474 856 | 5/1977 | United Kingdom . |
| 1 494 760 | 12/1977 | United Kingdom . |
| 1 516 848 | 7/1978 | United Kingdom . |
| 1 571 003 | 7/1980 | United Kingdom . |
| 1 591 515 | 6/1981 | United Kingdom . |
| 2 116 200 | 9/1983 | United Kingdom . |
| 2 222 411 | 3/1990 | United Kingdom . |
| 2 288 187 | 10/1995 | United Kingdom . |
| WO 92/03525 | 3/1992 | WIPO . |
| WO 92/07928 | 3/1992 | WIPO . |
| WO 92/06163 | 4/1992 | WIPO . |
| WO 95/14767 | 6/1995 | WIPO . |
| WO 95/27027 | 10/1995 | WIPO . |
| WO 95/27028 | 10/1995 | WIPO . |

*Primary Examiner*—Paul Lieberman
*Assistant Examiner*—Lorna M. Douyon
*Attorney, Agent, or Firm*—Rimma Mitelman

[57] ABSTRACT

In order to enhance the stability of sodium percarbonate bleach in particulate detergent compositions, crystalline aluminosilicate and a water-soluble alkali metal silicate in an amount of from 1–20% by weight based on the aluminosilicate are included in the non-spray dried base powder. In order to obtain the stabilizing effect, the crystalline aluminosilicate comprises zeolite MAP or the alkali metal silicate is homogeneously dispersed with respect to the aluminosilicate.

11 Claims, No Drawings

PARTICULATE ALUMINOSILICATE-BUILT DETERGENT COMPOSITIONS COMPRISING COGRANULES OF ZEOLITE MAP AND ALKALI METAL SILICATE

TECHNICAL AREA

The present invention relates to particulate detergent compositions of high bulk density, prepared by non-spray-drying processes, and containing crystalline aluminosilicate (zeolite) builder.

BACKGROUND

Particulate detergent compositions of high bulk density (650 g/liter) prepared by non-tower (non-spray-drying) processes are well known in the prior art and widely available on the market. Many such products contain zeolite builder, either conventional zeolite A or, more recently, zeolite MAP (zeolite P having a silicon to aluminium ratio not exceeding 1.33:1) as described and claimed in EP 384 070B (Unilever). These compositions normally comprise as a principal component a granular base powder, containing the main organic and inorganic ingredients (notably surfactants and builders) in composite granules of high bulk density, and some separate granular or particulate components containing less robust ingredients such as bleaches, enzymes and foam control granules. These separate components are often referred to as postdosed components.

Alkali metal silicate, especially sodium silicate, has been a well-known ingredient of particulate detergent compositions for many years. In spray-dried powders it is normally included in the base powder, but postdosing of granular sodium disilicate is also known.

However, it is also known that zeolite A and sodium silicate together, especially if processed at high temperatures, tend to interact to form insoluble material which is detectable as "grit" or "insolubles" deposited on washed fabrics. There is therefore a prejudice against including sodium silicate together with zeolite A in a detergent base powder, whether spray-dried or non-tower.

Another problem associated with zeolite-built powders, especially those of high bulk density, is the poor stability of sodium percarbonate bleach. In recent years the replacement of sodium perborate by sodium percarbonate has become increasingly desirable for both environmental and performance reasons, but sodium percarbonate is significantly less stable to moisture than is sodium perborate, and this is a particular problem in powders built with zeolite which contain higher amounts of mobile water than do phosphate-built powders. The problem is exacerbated in high bulk density powders where the ingredients are forced into closer proximity.

It has now surprisingly been found that alkali metal silicate, if included in a high bulk density zeolite-based detergent base powder in very finely divided or film form in intimate association with the zeolite, can give a number of benefits, the most striking of which is increased stability of sodium percarbonate. In one preferred embodiment of the invention, the liquid carrying capacity of the base powder is enhanced, allowing higher proportions of high-performance liquid surfactants (especially nonionic surfactants) to be included; and "grit" or "insolubles" formation is also reduced.

PRIOR ART

EP 657 527A (Procter & Gamble) discloses the use of sodium silicate in percarbonate detergent powders to stabilise certain oxidation-sensitive ingredients, for example, fluorescers, against oxidation by the percarbonate.

EP 639 639A (Procter & Gamble) discloses percarbonate detergent powders containing postdosed sodium silicate, in which at least 0.7 wt % of fine silicate particles are present.

EP 384 070B (Unilever) discloses zeolite MAP and its use as a detergency builder. EP 565 364A (Unilever) discloses a preferred method of preparation.

EP 521 635A (Unilever C3412) discloses that zeolite MAP has a substantially greater liquid carrying capacity than does zeolite A.

EP 522 726A (Unilever Case C3413) discloses that percarbonate detergent powders built with zeolite MAP exhibit better percarbonate storage stability than powders built with zeolite A.

WO 95 27027A and WO 95 27028A (Procter & Gamble) disclose detergent compositions containing zeolite MAP and sodium silicate.

DEFINITION OF THE INVENTION

In its first aspect, the present invention provides a particulate detergent composition having a bulk density of at least 650 g/liter, comprising (a) a granular non-spray-dried base powder comprising one or more organic surfactants and one or more detergency builders including a crystalline aluminosilicate, and (b) optionally one or more separate particulate components, characterized in that the granular non-spray-dried base powder further comprises a water-soluble alkali metal silicate homogeneously dispersed with respect to the aluminosilicate, in an amount of from 1 to 20 wt % based on the aluminosilicate (anhydrous basis).

In its second aspect, the present invention provides a process for the preparation of a particulate detergent composition as claimed in claim 1, which comprises the steps of:

(i) preparing a premix or cogranule of the aluminosilicate with a water-soluble alkali metal silicate in which the silicate is homogeneously dispersed with respect to the aluminosilicate, (ii) mixing the premix or cogranule of step (i) with organic surfactants, detergency builders and other ingredients in a mixer/granulator to form the granular non-spray-dried base powder, (iii) optionally admixing other ingredients as separate particulate materials.

In its third aspect, the present invention provides a particulate detergent composition having a bulk density of at least 650 g/liter, comprising (a) a granular non-spray-dried base powder comprising one or more organic surfactants and one or more detergency builders including a crystalline aluminosilicate, and (b) optionally one or more separate particulate components, characterized in that the crystalline aluminosilicate is zeolite MAP and that the granular non-spray-dried base powder further comprises a water-soluble alkali metal silicate in an amount of from 1 to 20 wt % based on the aluminosilicate (anhydrous basis).

A fourth aspect of the present invention is the use of a crystalline aluminosilicate having an alkali metal aluminosilicate homogeneously dispersed with respect thereto, in an amount of from 1 to 20 wt % based on the aluminosilicate (anhydrous basis), to increase the storage stability of sodium percarbonate in a particulate detergent composition.

DETAILED DESCRIPTION OF THE INVENTION

The particulate detergent compositions of the invention are of high bulk density: at least 650 g/liter and preferably at least 700 g/liter.

The compositions comprise a granular base powder which is a composite granule, prepared by a mixing and granulation process, containing surfactants, builders and other robust components of the formulation. Optionally, and preferably, the compositions also comprise one or more separate (postdosed) granular or particulate components.

It is an essential feature of the invention that the base powder should contain a crystalline aluminosilicate, preferably an alkali metal aluminosilicate, more preferably a sodium aluminosilicate; and that a water-soluble alkali metal silicate, preferably sodium silicate, should also be present in the base powder. The sodium silicate should be homogeneously dispersed with respect to the aluminosilicate. However, where the crystalline aluminosilicate is zeolite MAP (see below), the scope of the invention extends to any composition in which a water-soluble alkali metal silicate is present together with the zeolite MAP in a non-spray-dried base powder.

The aluminosilicate may generally be incorporated in amounts of from 10 to 70% by weight (anhydrous basis), preferably from 25 to 50 wt %. Aluminosilicates are materials having the general formula:

$$0.8\text{–}1.5\ M_2O.\ Al_2O_3.\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

The zeolite used in the compositions of the present invention may be the commercially available zeolite A (zeolite 4A) now widely used in laundry detergent powders. However, according to a preferred embodiment of the invention, the zeolite incorporated in the compositions of the invention is maximum aluminium zeolite P (zeolite MAP) as described and claimed in EP 384 070B (Unilever), and commercially available as Doucil (Trade Mark) A24 from Crosfield Chemicals Ltd, UK.

Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20. Especially preferred is zeolite MAP having a silicon to aluminium ratio not exceeding 1.07, more preferably about 1.00. The calcium binding capacity of zeolite MAP is generally at least 150 mg CaO per g of anhydrous material.

The water-soluble alkali metal silicate is preferably sodium silicate having a $SiO_2$:$Na_2O$ mole ratio within the range of from 1.6:1 to 4:1.

The water-soluble silicate is present in an amount of from 1 to 20 wt %, preferably 3 to 15 wt % and more preferably 5 to 10 wt %, based on the aluminosilicate (anhydrous basis).

It is important that the silicate be dispersed homogeneously with respect to the zeolite, so that throughout the base powder the ratio of zeolite to silicate is substantially constant.

In principle, it would be possible to admix very finely divided solid sodium silicate with the zeolite to form a coating of very fine particles.. However, in practice that is not easy to achieve using solid forms of sodium silicate which are generally of insufficiently small particle size. For example, granular sodium disilicate has an average particle size of about 200 μm. This material can in theory be milled to give smaller particle size material, but the milled powder is impossibly dusty and difficult to handle.

An exception is layered silicate as described and claimed in U.S. Pat. Nos. 4,664,839, 4,728,443 and 4,820,439 (Hoechst AG). This is material of the formula $$NaMSi_xO_{2x+1}\cdot yH_2O$$

wherein M denotes sodium or hydrogen, preferably sodium; x is a number from 1.9 to 4; and y is a number from 0 to 20. These crystalline materials can easily be characterized by means of their X-ray diffraction patterns. Preferred materials are those in which x=2, ie compounds of the formula $$NaMSi_2O_5\cdot yH_2O.$$

Both natural and synthetic compounds of this formula are of interest, the synthetic material known as Na-SKS-6, commercially available from Hoechst AG being especially preferred. It is available as a powder having an average particle size of about 30 μm.

Therefore, in one embodiment of the invention, the water-soluble alkali metal silicate is in the form of particles having an average particle size not exceeding 100 μm, and preferably not exceeding 50 μm, intimately mixed with and homogeneously dispersed on the aluminosilicate. The preferred silicate in this embodiment is crystalline layered silicate, more preferably Na-SKS-6. This embodiment is applicable both to zeolite A and to zeolite MAP.

An alternative route to achieving a very high degree of homogeneity with respect to the zeolite is to deposit the water-soluble silicate from solution onto the zeolite particles. That might be carried out, for example, by adding an alkali metal silicate, either solid or aqueous solution, to an aqueous zeolite slurry, and then drying. This step could be incorporated in the manufacture of the zeolite before the final drying stage.

With zeolite A, however, it has been found that this procedure leads to the formation of agglomerates of large particle size.

With zeolite MAP, on the other hand, this procedure gives a modified zeolite, which might also be described as a zeolite/silicate cogranule, having a small particle size and highly suitable for incorporation in a non-spray-dried detergent base powder.

Therefore, according to a preferred embodiment of the invention, the crystalline aluminosilicate is zeolite P having a silicon:aluminium ratio not exceeding 1.33 (zeolite MAP); and according to an especially preferred embodiment of the invention, the zeolite MAP and the alkali metal silicate together form cogranules in which the alkali metal silicate is deposited on the zeolite MAP particles.

The alkali metal silicate, preferably in solution form, may be added to a slurry of undried zeolite MAP as obtained, for example, in Example 11 of EP 565 364A (Unilever). The slurry may suitably have a solids content of from 20 to 46 wt %, preferably from 30 to 40 wt %. By "undried" zeolite MAP is meant zeolite MAP as obtained after washing and filtering but before drying.

The cogranules generally have an average particle size of from 1 to 10 μm, more preferably from 1.5 to 6 μm and most preferably from 2.5 to 5 μm. This particle size is highly suitable for non-tower detergent processing and contributes to the avoidance of insoluble residues on washed fabrics. The particle size and distribution are similar to those of zeolite MAP as received.

This embodiment of the invention gives another advantage in addition to improved sodium percarbonate stability. The cogranule or modified zeolite exhibits a significantly higher liquid carrying capacity than does zeolite MAP itself. Since zeolite MAP itself is of greater liquid carrying capacity than zeolite A, the use of the cogranule of the invention leads to a substantial benefit to the art in terms of liquid carrying capacity. Higher levels of high-performance mobile surfactants, for example ethoxylated alcohol nonionic surfactants, can be incorporated without loss of flow, crispness and other powder properties.

It has been noted that, when fast drying the zeolite MAP filter cake obtained in the process disclosed in the above-mentioned EP 565 364A (Unilever), the particle size decreases from about 3 $\mu$m to about 1 $\mu$m. However, if the drying is carried out in the presence of sodium silicate, to give cogranules in accordance with the present invention, the average particle size remains unchanged at about 3 $\mu$m. In view of this behaviour the increase in liquid carrying capacity is surprising, since the prior art teaches that liquid carrying capacity decreases as particle size increases (and vice versa).

The cogranules have been found to have a pH within the range of from 10 to 12, which is relatively low for a zeolite and sufficiently low to avoid classification as an irritant. The cogranules therefore also provides a route for incorporating sodium silicate into detergent powders without the need for handling higher-pH (therefore potentially irritant) sodium silicate in the detergent factory. Drying of the zeolite/silicate slurry in air containing carbon dioxide appears to result in partial neutralisation of the sodium silicate on the surface of the cogranules, hence the relatively low pH.

If desired, the cogranules may contain other detergent-functional ingredients. For example, the cogranules may additionally comprise an organic polycarboxylate, aminocarboxylate or aminophosphonate sequestrant. Examples of such materials include polyacrylate, acrylate/maleate copolymers, ethylenediamine tetraacetate (EDTA), and diethylenetriamine tetramethylene phosphate (EDTMP).

DETERGENT COMPOSITIONS

The detergent compositions of the invention will contain, as essential ingredients, one or more detergent-active compounds (surfactants) which may be chosen from soap and non-soap anionic, cationic, nonionic, amphoteric and zwitterionic detergent-active compounds, and mixtures thereof.

Many suitable detergent-active compounds are available and are fully described in the literature, for example, in "Surface-Active Agents and Detergent", Volumes I and II, by Schwartz, Perry and Berch.

The preferred detergent-active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The choice of detergent-active compound (surfactant), and the amount present, will depend on the intended use of the detergent composition. For example, for machine dishwashing a relatively low level of a low-foaming nonionic surfactant is generally preferred. In fabric washing compositions, different surfactant systems may be chosen, as is well known to the skilled formulator, for handwashing products and for products intended for use in different types of washing machine.

The total amount of surfactant present will also depend on the intended end use and may be as low as 0.5 wt %, for example, in a machine dishwashing composition, or as high as 60 wt %, for example, in a composition for washing fabrics by hand. In compositions for machine washing of fabrics, an amount of from 5 to 40 wt % is generally appropriate.

Detergent compositions suitable for use in most automatic fabric washing machines generally contain anionic non-soap surfactant, or nonionic surfactant, or combinations of the two in any ratio, optionally together with soap.

Anionic surfactants, soaps and higher-ethoxylated nonionic surfactants may generally be included in the base powder. Lower-ethoxylated surfactants may more suitably be post-added.

The detergent compositions of the invention also contain one or more detergency builders. The total amount of detergency builder in the compositions will suitably range from 5 to 80 wt %, preferably from 10 to 60 wt %. Builders are normally wholly or predominantly included in the base powder.

As well as the crystalline aluminosilicate builders already mentioned, other inorganic or organic builders may be present. Inorganic builders that may be present include sodium carbonate, amorphous aluminosilicates, and phosphate builders, for example, sodium orthophosphate, pyrophosphate and tripolyphosphate.

The amount of aluminosilicate present in the compositions of the invention is preferably from 10 to 70% by weight (anhydrous basis), more preferably from 25 to 50 wt %.

Organic builders that may additionally be present include polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system. The invention is especially concerned with compositions containing peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. As indicated above, the invention is more especially concerned with compositions containing sodium percarbonate.

Bleach ingredients are invariably postdosed.

The sodium percarbonate may have a protective coating against destabilization by moisture. Sodium percarbonate having a protective coating comprising sodium metaborate and sodium silicate is disclosed in GB 2 123 044B (Kao).

The peroxy bleach compound, for example sodium percarbonate, is suitably present in an amount of from 5 to 35 wt %, preferably from 10 to 25 wt %.

The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabilizer (heavy metal sequestrant) may also be present. Suitable bleach stabilizers include ethylenediamine tetraacetate (EDTA) and the polyphosphonates such as Dequest (Trade Mark), EDTMP.

The compositions of the invention may also contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention. Sodium carbonate may be included in the base powder, or postdosed, or both.

Powder flow may be improved by the incorporation of a small amount of a powder structurant, for example, a fatty acid (or fatty acid soap), a sugar, an acrylate or acrylate/maleate polymer, in the base powder. A preferred powder structurant is fatty acid soap, suitably present in an amount of from 1 to 5 wt %.

Other materials that may be present in detergent compositions of the invention include antiredeposition agents such as cellulosic polymers; soil release polymers; fluorescers; inorganic salts such as sodium sulphate; lather control agents or lather boosters as appropriate; proteolytic and lipolytic enzymes; dyes; coloured speckles; perfumes; foam controllers; and fabric softening compounds.

The detergent compositions of the invention are prepared by non-spray-drying (non-tower) processes. The base powder is prepared by mixing and granulation, and other ingredients subsequently admixed (postdosed).

The base powder may suitably be prepared using a high-speed mixer/granulator. Processes using high-speed mixer/granulators are disclosed, for example, in EP 340 013A, EP 367 339A, EP 390 251A and EP 420 317A (Unilever).

The invention is further illustrated by the following Examples.

EXAMPLES 1 TO 4

PREPARATION OF ZEOLITE MAP/SILICATE COGRANULES

Example 1

A zeolite MAP obtained according to Example 11 of EP 565 364A (Unilever) was produced. Before drying, but after washing and filtering to 36% dry solids, to the zeolite slurry was added a sodium silicate solution ($SiO_2$:$Na_2O$ molar ratio 2) (43% dry solids) to reach a zeolite MAP/sodium silicate weight ratio of 10:1 (on dry basis). The obtained slurry was mixed well and subsequently dried in a VOMM dryer (obtainable from VOMM Impianti) using direct heated air ($CO_2$ content of the air approximately 2.2 wt %) to 90% dry solids.

Example 2

The same recipe as in Example 1 was used except that the zeolite MAP/sodium silicate weight ratio of the end slurry (after addition of sodium silicate) was 100:7.5 (on dry basis).

Example 3

A zeolite MAP obtained according to Example 11 of EP 565 364A (Unilever) was produced. Before drying, but after washing and filtering to 35% dry solids, to the zeolite slurry was added a sodium silicate solution ($SiO_2$:$Na_2O$ molar ratio of 2) (43% dry solids) to reach a zeolite MAP/sodium silicate weight ratio of 10:1 (on dry basis). This slurry was filtered to 40.9% dry solids.

The filtercake obtained was next mixed with a polymer solution (Narlex MA340, ex National Starch, 40% dry solids) to reach a zeolite/sodium silicate/polymer weight ratio of 20:2:1. The material obtained was subsequently dried in a Retsch laboratory-scale fluid bed dryer to 90% dry solids.

Example 4

A zeolite MAP obtained according to Example 11 of EP 565 364A (Unilever) was produced. Before drying, but after washing and filtering to 35% dry solids, to the zeolite slurry was added a sodium silicate solution ($SiO_2$:$Na_2O$ molar ratio 2) (43% dry solids) to reach a zeolite MAP/sodium silicate weight ratio of 100:8 (on dry basis). This slurry was filtered to 39.8% d.s. The obtained filtercake was next mixed with a polymer solution (Narlex MA340, ex National Starch, 40% d.s.) to reach a zeolite MAP/sodium silicate/polymer weight ratio of 100:8:4. The material obtained was subsequently dried in a Retsch laboratory-scale fluid bed dryer to 90% dry solids.

The following characteristics of the products were measured:

(i) Average weight particle size, $d_{50}$

The quantity "$d_{50}$" indicates that 50% by weight of the particles have a diameter smaller than that figure, and may be measured using a Sedigraph (Trade Mark), type 5100, ex Micromeritics.

(ii) pH pH measurements were performed by making a 5% dispersion of zeolite (dry solids basis) in demineralized water, followed by measurement with a Orion EA940 ion analyzer, using a Orion 9173b pH-electrode.

(iii) CEBC (Calcium Effective Binding Capacity)

The CEBC was measured in the presence of a background electrolyte to provide a realistic indicator of calcium ion uptake in a wash liquor environment. A sample of each zeolite was first equilibrated to constant weight over a saturated sodium chloride solution and the water content measured. Each equilibrated sample was dispersed in water (1 $cm^3$) in an amount corresponding to 1 g $dm^{-3}$ (dry), and the resulting dispersion (1 $cm^3$) was injected into a stirred solution, consisting of 0.01M NaCl solution (50 $cm^3$) and 0.05M $CaCl_2$ (3.923 $cm^3$), therefore producing a solution of total volume 54.923 $cm^3$. This corresponded to a concentration of 200 mg CaO per liter, i.e. just greater than the theoretical maximum amount (197 mg) that can be taken up by a zeolite of Si:Al ratio 1.00. The change in $Ca^{2+}$ ion concentration was measured by using a $Ca^{2+}$ ion selective electrode, the final reading being taken after 15 minutes. The temperature was maintained at 25° C. throughout. The $Ca^{2+}$ ion concentration measured was subtracted from the initial concentration, to give the effective calcium binding capacity of the zeolite sample as mg CaO/g zeolite (on dry basis).

(iv) LCC (Liquid Carrying Capacity)

This was determined on the basis of the ASTM spatula rub-out method (American of Test Material Standards D281). The test is based on the principle of mixing nonionic surfactant ($C_{12-15}$ alcohol ethoxylated with an average of 3 moles of ethylene oxide per mole: Synperonic A3, available from ICI) with the particulate zeolite by rubbing with a spatula on a smooth surface until a stiff putty-like paste is formed which will not break or separate when it is cut with the spatula. The weight of nonionic surfactant used is then put into the equation:

$$LCC = \frac{\text{wt of nonionic absorbed (g)}}{\text{wt of zeolite (g)}} \times 100 = \text{g nonionic/100g zeolite}$$

(v) Grit (insolubles)

Grit is defined here as the percentage of particules which are left behind on a 45 μm sieve. Zeolite is slurried with water in a beaker, ultrasonically treated for 15 min. and next placed in the sieving machine (Mocker). This machine is subsequently flushed with water (waterpressure appr. 4 bar) for a certain period of time. The sieve is removed from the machine and dried in an oven (90° C., 15 min.) and the amount of residue determined.

$$\text{grit (\%)} = \frac{\text{residue (g)}}{\text{wt of zeolite (dry basis) (g)}}$$

Results

| Example | 1 | 2 | 3 | 4 |
|---|---|---|---|---|
| $d_{50}$ (μm) | 3.12 | 2.8 | 2.8 | 2.8 |
| pH | 11.3 | 11.1 | 11.7 | 11.7 |
| CEBC | 134 | 142 | 137 | 131 |
| LCC (%) | 83 | 82 | 72 | 73 |
| Grit (%) | 0.27 | 0.13 | 0.01 | 0.01 |

EXAMPLE 5, COMPARATIVE EXAMPLES A AND B

PERCARBONATE STABILITY

In this series of experiments, the following zeolites or modified zeolites (cogranules) were used:

Comparative Example A: zeolite 4A (Wessalith P ex Degussa)

Comparative Example B: zeolite MAP (Doucil A24 ex Crosfield)

Example 5: the cogranule of Example 1

The hydrated zeolites were each mixed with sodium percarbonate in the weight ratio 3.75:1.25 g and stored under very severe conditions: in open-topped bottles at 37° C./70% RH.

The percarbonate in all cases was "Oxyper" ex Interox, used as a 500–710 μm sieve fraction.

Samples were removed from storage at frequent intervals and the percentage available oxygen remaining determined by titration with potassium permanganate. The results are shown below.

| % remaining after storage time (days) | A | B | 5 |
|---|---|---|---|
| 0 | 100 | 100 | 100 |
| 2 | 68.7 | 80.7 | 90.3 |
| 4 | 51.7 | 60.5 | 78.3 |
| 7 | 23.8 | 45.6 | 68.7 |
| 10 | 15.0 | 27.4 | 58.1 |

These results clearly show that percarbonate is more stable in the presence of the zeolite/silicate cogranule of Example 1 than in the presence of either zeolite 4A or zeolite MAP. However, zeolite MAP is considerably better than zeolite 4A.

EXAMPLES 6 TO 10

DETERGENT COMPOSITIONS

EXAMPLE 6, COMPARATIVE EXAMPLE C

In the following experiment, percarbonate stability in fully formulated detergent compositions of high bulk density (>700 g/liter) was compared.

The base powders were prepared by non-tower mixing and granulation using a Lodige (Trade Mark) CB Recycler, and the remaining ingredients were postdosed. The formulations were as shown overleaf.

The powders were stored under very severe conditions: in open tubs at 37° C./70% relative humidity. Samples were removed from storage after 1 week, 2 weeks and 3 weeks, and the percentage available oxygen remaining determined by titration with potassium permanganate. The results are shown below.

| % remaining after storage for | C | 6 |
|---|---|---|
| 1 week | 62 | 79 |
| 2 weeks | 27 | 38 |
| 3 weeks | 23 | 29 |

These results show that use of the modified zeolite (zeolite/silicate cogranule) of Example 1 gave significantly better percarbonate stability in these formulations.

| | 6 | C |
|---|---|---|
| Base powder | | |
| Na PAS[1] | 5.67 | 11.76 |
| Nonionic surfactant | 11.31 | 5.87 |
| Soap | 1.81 | 1.84 |
| Zeolite MAP*/silicate[2] | 24.40 | — |
| Zeolite MAP* | — | 22.74 |
| Na citrate 2aq | 3.97 | 3.31 |
| Light soda ash | 5.00 | 2.33 |
| SCMC (as received) | — | 0.91 |
| Moisture, salts, etc to | 53.80 | 53.80 |
| Postdosed ingredients | | |
| Antifoam, fluorescer | 3.79 | 3.79 |
| Soil release polymer[3] | 5.00 | 5.00 |
| Copolymer granules[4] | 1.00 | 1.00 |

-continued

| | 6 | C |
|---|---|---|
| Na carbonate | 8.38 | — |
| Na bicarbonate | 1.00 | 0.95 |
| Carbonate/silicate[5] | — | 8.43 |
| TAED (83%) | 5.50 | 5.50 |
| Na percarbonate[6] | 19.00 | 19.00 |
| EDTMP Ca salt | 1.00 | 1.00 |
| Protease | 0.78 | 0.78 |
| Lipase | 0.25 | 0.25 |
| Amylase | 0.05 | 0.05 |
| Perfume | 0.45 | 0.45 |

*Zeolite percentages are quoted as anhydrous material
[1]Primary alcohol sulphate, Na salt
[2]Zeolite MAP/10 wt % Na silicate cogranules as in Example 1 above
[3]Sokalan (Trade Mark) HP22 ex BASF, 18% on zeolite/carbonate carrier
[4]Acrylate/maleate copolymer, Sokalan (Trade Mark) CP5 ex BASF
[5]29 wt % silicate/carbonate cogranule; Nabion (Trade Mark) 15 ex Rhône-Poulenc
[6]Coated, 13.25 $avO_2$.

EXAMPLES 7 TO 10

The following are further examples of high bulk density (>700 g/liter) particulate detergent compositions in accordance with the present invention. The base powders were prepared by non-tower mixing and granulation using a Lodige (Trade Mark) CB Recycler, and the remaining ingredients were postdosed.

The zeolite/silicate cogranules were the same as those used in Example 6.

EXAMPLES 7 TO 10

FORMULATIONS

| | 7 | 8 | 9 | 10 |
|---|---|---|---|---|
| Base powder | | | | |
| Na PAS | 8.14 | 5.09 | 10.65 | 6.40 |
| Nonionic 7EO | 9.69 | 12.76 | 12.68 | 6.03 |
| Soap | 1.51 | 2.02 | 1.98 | 2.54 |
| Zeolite MAP | 19.37 | 22.90 | 25.35 | 8.78 |
| with Na silicate | 2.55 | 2.86 | 3.34 | 3.60 |
| Na citrate 2aq | 4.12 | 4.11 | 5.40 | 5.16 |
| Light soda ash | 2.16 | 1.35 | 2.83 | 1.70 |
| Fluorescer | 0.04 | 0.01 | 0.06 | 0.01 |
| SCMC (as received) | 0.50 | 0.50 | 0.50 | 0.50 |
| Moisture, salts, etc | 5.91 | 4.61 | 7.73 | 5.79 |
| Postdosed ingredients | | | | |
| Antifoam granule | 3.79 | 3.79 | 3.79 | 3.79 |
| Fluorescer granule | 0.50 | 0.50 | — | — |
| Polyvinyl pyrrolidone | — | — | 0.50 | 0.50 |
| Soil release polymer | 5.00 | 5.00 | 6.50 | 6.50 |
| Copolymer granules | 1.00 | 1.00 | 1.26 | 1.26 |
| Na citrate 2aq | — | — | 10.00 | 10.00 |
| Na carbonate | 2.76 | 0.56 | — | — |
| Na bicarbonate | 1.00 | 1.00 | — | — |
| Carbonate/silicate | 5.50 | 5.50 | 5.50 | 5.50 |
| TAED (83%) | 5.50 | 5.50 | — | — |
| Na percarbonate | 19.00 | 19.00 | — | — |
| EDTMP Ca salt | 0.42 | 0.42 | 0.42 | 0.42 |
| Protease | 0.78 | 0.78 | 0.78 | 0.78 |
| Lipase | 0.25 | 0.25 | 0.25 | 0.25 |
| Amylase | 0.05 | 0.05 | 0.05 | 0.05 |
| Perfume | 0.45 | 0.45 | 0.45 | 0.45 |

We claim:

1. A particulate detergent composition having a bulk density of at least 650 g/liter, comprising (a) a granular non-spray-dried base powder comprising one or more organic surfactants and one or more detergency builders including zeolite P having a silicon:aluminium ratio not exceeding 1.33 (zeolite MAP), (b) optionally one or more separate particulate components, (c) a water-soluble alkali metal silicate in an amount of from 1 to 20 wt % based on the zeolite MAP on an anhydrous basis, wherein the zeolite MAP and alkali metal silicate together form cogranules having an average particle size of from 1 to 10 $\mu$m in which the alkali metal silicate is deposited on the zeolite MAP particles.

2. A particulate detergent composition as claimed in claim 1, wherein the water-soluble silicate is present in an amount of from 3 to 15 wt % based on the zeolite MAP.

3. A particulate detergent composition as claimed in claim 1, wherein the water-soluble silicate is present in an amount of from 5 to 10 wt % based on the zeolite MAP.

4. A particulate detergent composition as claimed in claim 1, wherein the water-soluble silicate is sodium silicate having a $SiO_2$:$Na_2O$ mole ratio within the range of from 1.6:1 to 4:1.

5. A particulate detergent composition as claimed in claim 1, wherein the cogranules have an average particle size of from 1.5 to 6 $\mu$m.

6. A particulate detergent composition as claimed in claim 1, wherein the cogranules have an average particle size of from 2.5 to 5 $\mu$m.

7. A particulate detergent composition as claimed in claim 1, wherein the cogranules additionally comprise an organic polycarboxylate, aminocarboxylate or aminophosphonate sequestrant.

8. A particulate detergent composition as claimed in claim 1, wherein the cogranules have a pH within the range of from 10 to 12.

9. A particulate detergent composition as claimed in claim 1, which further comprises, as a separate particulate component (b), a peroxy bleach compound.

10. A particulate detergent composition as claimed in claim 9, wherein the peroxy bleach compound comprises sodium percarbonate.

11. A process for increasing the storage stability of sodium percarbonate in a particulate detergent composition having a bulk density of at least 650 g/liter, said composition comprising (a) a granular non-spray-dried base powder comprising one or more organic surfactants and one or more detergency builders including zeolite P having a silicon:aluminium ratio not exceeding 1.33 (zeolite MAP), (b) sodium percarbonate as a separate particulate component, which process comprises incorporating in said granular non-spray-dried base powder a water-soluble alkali metal silicate in an amount of from 1 to 20 wt % based on the zeolite MAP on an anhydrous basis, wherein the zeolite MAP and alkali metal silicate together form cogranules having an average particle size of from 1 to 10 $\mu$m in which the alkali metal silicate is deposited on the zeolite MAP particles.

* * * * *